US007850052B2

(12) United States Patent
Thatcher

(10) Patent No.: US 7,850,052 B2
(45) Date of Patent: Dec. 14, 2010

(54) WAISTPACK HAVING QUICK ACCESS/DEPOSIT HYDRATION BOTTLE

(75) Inventor: Bryce Thatcher, Sugar City, ID (US)

(73) Assignee: Penguin Brands, Inc., Sharon Hill, PA (US)

( * ) Notice: Subject to any disclaimer, the term of this patent is extended or adjusted under 35 U.S.C. 154(b) by 1053 days.

(21) Appl. No.: 11/323,813

(22) Filed: Dec. 31, 2005

(65) Prior Publication Data

US 2007/0080182 A1 Apr. 12, 2007

Related U.S. Application Data

(60) Provisional application No. 60/724,695, filed on Oct. 7, 2005.

(51) Int. Cl.
*A45F 5/00* (2006.01)
*A45F 3/00* (2006.01)

(52) U.S. Cl. ..... 224/148.4; 224/242; 224/662; 224/680; 224/682

(58) Field of Classification Search ... 224/148.1–148.7, 224/662, 682, 242, 235, 246, 250, 251
See application file for complete search history.

(56) References Cited

U.S. PATENT DOCUMENTS 4,449,654 A * 5/1984 Cappis ..... 224/148.6
4,871,597 A * 10/1989 Hobson ..... 428/36.1
5,282,559 A * 2/1994 Wisser et al. ..... 224/243
5,305,874 A * 4/1994 McLaughlin ..... 206/37
5,624,065 A * 4/1997 Steffe ..... 224/625
6,182,872 B1 * 2/2001 Six ..... 224/148.5
6,241,135 B1 * 6/2001 Thatcher ..... 224/148.5
2003/0218035 A1 * 11/2003 Willows et al. ..... 224/148.4

OTHER PUBLICATIONS

One color page relating to "Gemini" pack (undated).
One color page relating to "Apogee" pack (undated).
One color page relating to "Evaporaide" pack (undated).
One color page relating to EvaporAide Plus (undated).
One color page relating to "AirFlow Belt" (undated).
One color page entitled "Ultimate Direction: High Performance Equipment for Endurance Sports" (1992-93).

* cited by examiner

*Primary Examiner*—Nathan J Newhouse
*Assistant Examiner*—Adam Waggenspack
(74) *Attorney, Agent, or Firm*—John J. Skinner, Jr.; Michelman & Robinson, LLP

(57) ABSTRACT

Apparatus transportable by an exercising person, for maintaining a liquid drink within one-handed reach while the person is exercising, includes a container for the liquid drink, an adjustable belt for fitting about the person's waist, a holster connected to the belt, for releasably retaining therewithin the container, and a cradling web extending between the holster and the belt, connected thereto at respective web extremities but being arcuately spaced therefrom along a middle portion of the web.

7 Claims, 16 Drawing Sheets

WAISTPACK HAVING QUICK ACCESS/DEPOSIT HYDRATION BOTTLE

CROSS-REFERENCE TO RELATED PATENT APPLICATION

This application claims the priority under 35 USC 119 of U.S. provisional patent application Ser. No. 60/724,695, entitled "Container with Openable Snap Ring for Attachment" filed 7 Oct. 2005 in the name of Bryce Thatcher. The disclosure of application Ser. No. 60/724,695 is hereby incorporated by reference.

BACKGROUND OF THE INVENTION AND DESCRIPTION OF THE PRIOR ART

Joggers, runners, cyclists, rock and mountain climbers, and other outdoor enthusiasts need periodic, sometimes nearly continuous, hydration. One prior art approach to the hydration problem is to provide an elastic tube, much like a rubber band, to retain a water bottle in place within a runner's carriage or harness as the runner is running. Carrying a hydration bottle filled with water or other liquid may be awkward, especially for those engaged in relatively active pursuits, such as jogging, bicycling, running, and the like. In addition to being awkward, carrying a bottle of water poses difficult challenges. The water bottle tends to bounce against the carrier's body, thereby creating discomfort and distraction. Additionally, the water within the bottle may slosh around, especially as the bottle is emptied, thereby changing the dynamics of carrying the bottle and the weight associated therewith. As a result, known apparatus for carrying hydration bottles is cumbersome and deficient in many respects.

SUMMARY OF THE INVENTION

In one of its aspects, this invention provides apparatus, transportable by an exercising person, for maintaining a drinking liquid supply within reach of the person during exercise without the person using the person's limbs where the apparatus includes a container for holding the liquid for drinking, an adjustable belt for fitting around the person's waist, a holster connected to the belt for reversibly retaining therewithin the bottle and a cradling web extending between the holster and the belt with the cradling web being connected to the holster and the belt at respective cradling web extremities but being separated from the cup and from the belt along a middle portion of the web. The cradling web end connected to the belt is preferably transverse to the belt centerline. The cradling web end connected to the holster is preferably parallel with the holster lip and connected to the holster at the holster lip. The cradling web is stiffer than both the holster and the belt. The holster retains the container frictionally within the holster and releases the container responsively to force applied to the container by the person using one hand.

In another one of its aspects, this invention provides apparatus for maintaining a beverage container within reach of an exercising person carrying the container where the apparatus includes an adjustable elastic belt for fitting around the person at the waist, a holster connected to the belt for releasably retaining therewithin a generally cylindrical beverage container upon application of manual force thereto by the exercising person using but one hand, a cradling web connecting the holster and the belt at respective web extremities and being arcuately separated therefrom along the middle portion of the web with one cradling web end connected to the belt preferably being transverse to the belt centerline and the remaining cradling web end connected to the holster lip and being aligned therewith. The cradling web is stiffer than both the holster and the belt. The belt is preferably elasticized fabric. The holster preferably has a "D-shape" cross section with the flat side of the "D" connected to the belt so as to be proximate the person's body when the apparatus is worn. Alternatively, and less preferably the holster may be of generally cylindrical cross section.

In yet another one of its aspects, this invention provides apparatus for maintaining a beverage container within reach of an exercising person carrying the container where the apparatus includes a belt wearable about the torso of the person where the belt has a pair of elastic segments, and includes male and female members of a releasable clasp at respective ends of respective segments for selectively connecting the segments together, a horizontally elongated fabric segment positioned between and connected proximate its horizontal extremities to those ends of the respective elastic segments which are remote from the clasp members, with the elastic end fabric segments of the belt facilitating adjustable close fitting of the belt about the torso when the elastic segments are connected by the clasp. The apparatus further includes a holster connected preferably to the fabric segment of the belt for releasably retaining therewithin a generally cylindrical beverage container.

The apparatus yet further includes a cradling web extending between the holster and the belt fabric segment and being connected thereto at respective cradling web extremities but being arcuately separated therefrom along a middle portion of the web. A cradling web end connected to the fabric segment is preferably transverse to the belt centerline with the cradling web end connected to the holster being connected thereto at a lip portion of the holster and being aligned with the lip. The holster may be oriented at an angle to the vertical of at least 45°, or may be horizontal or at other orientations, and is preferably positioned substantially opposite from the clasp when the belt is worn. The holster cross section is within a preselected range relating to the diameter of the preferably cylindrical bottle in order to provide force preventing the bottle from exiting the holster in response to movement of the holster as the person traverses over ground but permitting the beverage container to be withdrawn from the holster and thereafter replaced back into the holster by the person using one hand, for holster retention of the beverage container, while the person is traversing over ground.

A major advantage of this invention is that the cradle and belt combination, provided by a cradle member and holster affixed to an elastic belt member having a fabric segment at the central portion thereof, is that while the cradle and belt are in position, the cradle remains open so that when a runner reaches behind his or her body, the runner may grasp a hydration container and pull the hydration container out of the cradle provided by the cradling member and holster. Once the runner has taken a drink from the hydration container, the runner may replace the hydration container back in the cradle defined by the cradle member and holster, without having to hold the holster open or otherwise adjust the holster or cradle member or other bottle-holding mechanism. The cradling member is preferably sewn in slight tension, in order that it may pull the outer portion of the holster towards the wearer's body, thereby pulling the hydration container and the cradle defined by the holster and cradle member towards the body as well. This is facilitated by fastening the belt of the apparatus fairly firmly around the wearer's body when worn.

A loop on the cap of the hydration container facilitates pull-out of the container from the cradle assembly, defined by the cradle member and holster, by the wearer using a single hand.

The cradle assembly for the body is essentially formed of foam. The foam is a fairly rigid foam to define the holster and maintain the holster in an open, tunnel-like disposition, when the container is removed from the holster. With apparatus embodying the invention, there is no need for any elastic loop to go over the nozzle or cap of the hydration container thereby to retain the hydration container in close proximity to the exercising person's body. Rather, there is a stable cradle provided by a holster and cradle member for the hydration container. The cradle member keeps the holster against the runner's body without the holster bouncing up and down due to the weight of the bottle being carried, thereby contributing to stability of the entire assembly as worn by a runner. Additionally, the configuration of the holster provides a runway or shoot or tunnel effect for the hydration container with the foam in part defining the interior configuration of the holster.

DESCRIPTION OF THE DRAWINGS

In FIG. 18 the bottle cap is depicted extending from the right opening of the holster. Certain details of the apparatus have been omitted from FIG. 18 to enhance drawing clarity.

Figure 1:
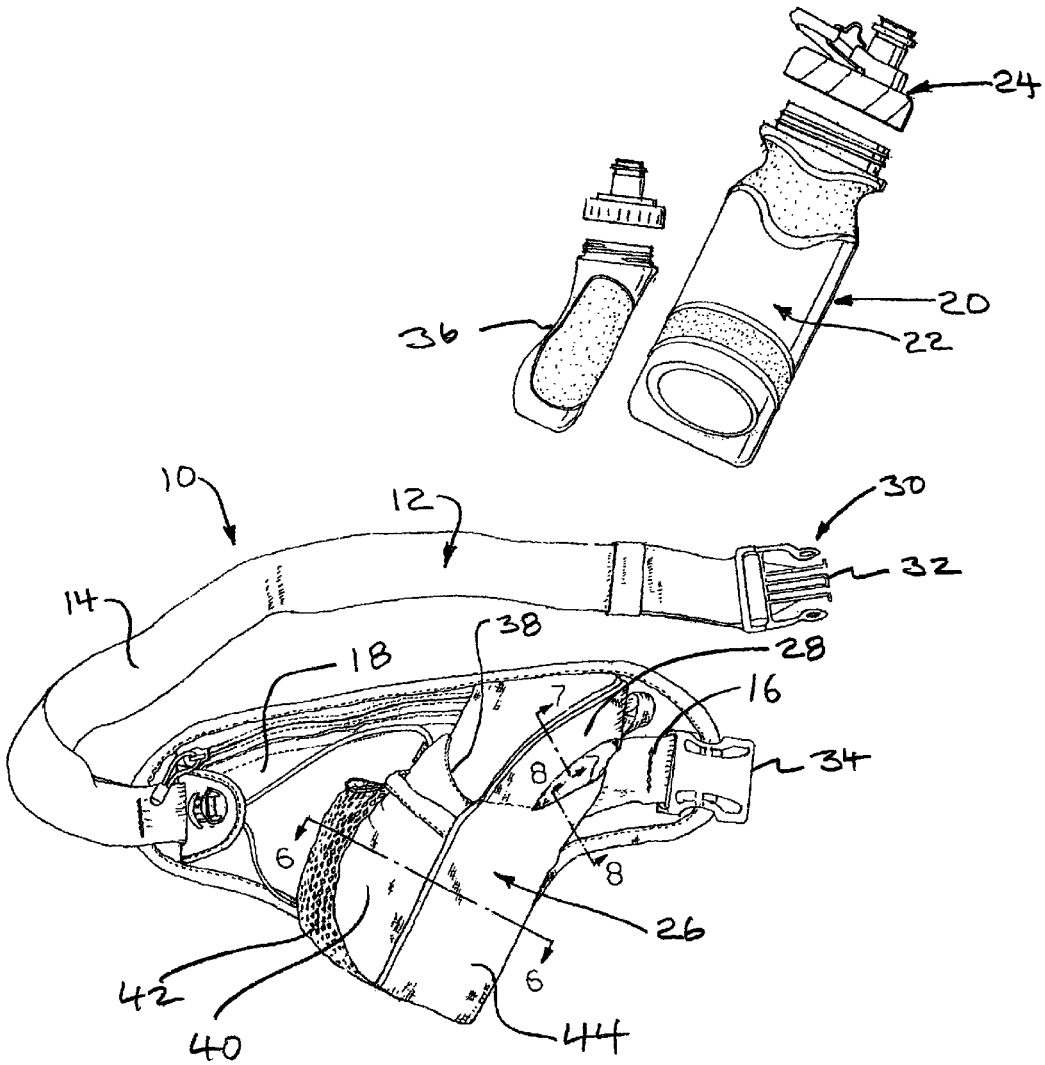
FIG. 1 is an exploded front elevation of apparatus for maintaining a hydration beverage container within reach of an exercising person carrying the container, in accordance with the preferred embodiment of the invention, with the hydration beverage container shown in position ready to be placed in, and carried by, a person using the apparatus. A smaller nutrition flask, which optionally may also be carried by the apparatus, is also depicted
Figure 2:
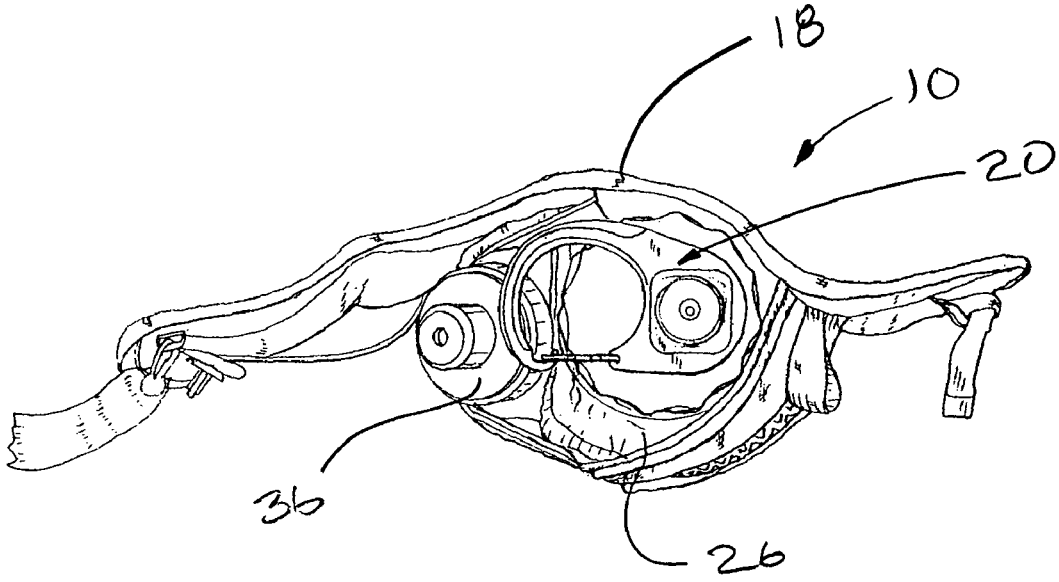
FIG. 2 is a top view of the apparatus illustrated in FIG. 1, with the beverage container and nutrition flask in position in the apparatus, but with the belt segments not completely shown.

In the drawings, prime, double prime, etc. notations denote further embodiments of the invention and analogous parts therein.

DESCRIPTION OF THE PREFERRED EMBODIMENTS AND THE BEST MODE KNOWN FOR PRACTICE OF THE INVENTION

Referring to the drawings in general and to FIG. 1 in particular, apparatus for maintaining a beverage container within reach of an exercising person carrying the container is designated generally 10 and includes a belt designated generally 12, where belt 12 includes a first elastic segment 14 and a second elastic segment 16, as well as a fabric segment 18 positioned between and connected to first and second elastic segments 14, 16. Fabric segment 18 provides as lumbar backing and preferably presents an air mesh moisture-wicking fabric to the exterior, for contacting the lumbar region of the person wearing the apparatus.

The beverage container, which apparatus 10 is adapted to maintain within reach of the exercising person carrying the apparatus, is designated generally 20 and is shown in position above and spaced from apparatus 10 in FIG. 1. Container 20 is a primary hydration container typically containing water or other fluid carried by the exercising person for hydration purposes. Container 20 includes a body designated generally 22 and a cap designated generally 24, where body 22 and cap 24 have been illustrated separated one from another in FIG. 1. Cap 24 is adapted to screw onto body 22 as indicated by the threads that are illustrated in FIG. 1 but not numbered to enhance drawing clarity.

Apparatus 10 further includes a holster designated generally 26 that serves to retain therewithin beverage container 20. Holster 26 has internal size and cross-sectional dimensions falling within a pre-selected range relative to the diameter and cross-sectional dimensions of body 22 of container 20. With the desired dimensional relationship between the interior of holster 26 and the exterior of body 22 of container 20, holster 22 prevents container 20 from exiting holster 22 in response to movement of holster 22 as the person wearing apparatus 10 traverses over ground. This same dimensional relationship permits container 20 to be withdrawn from holster 26 and thereafter placed back into holster 26 by the person wearing apparatus 10 using one hand, for retention of container 20 by holster 26, as the person wearing apparatus 10 continues to traverse over ground.

An arcuate cradle member 28, desirably having a web-like form, extends between holster 26 and fabric segment 18 of belt 12 and is connected, at respective extremities of cradle member 28, to holster 26 and to fabric segment 18 of belt 12. The mid section of cradle member 28 is arcuately separated from both holster 26 and fabric segment 18. The end of cradle member 28 connected to fabric segment 18 is preferably positioned to be transverse to the centerline of belt 12. The second end of cradle member 28, which is connected to holster 26 at a lip 38 of holster 26, is oriented so as to be aligned with lip 38 at the position of connection of the second end of cradle member 28 with holster 26.

Belt 12 is secured in position around the person wearing apparatus 10 by fastening a clasp, designed generally 30, having a male clasp portion designated generally 32 and a female clasp portion designated generally 34, by inserting male portion 32 into female portion 34. Apparatus 10 may further optionally include a secondary container, designated generally 36, for carrying nutritional fluids. Secondary container 36 may be carried in a flask pocket 40 defined in part by mesh 42.

The exterior of holster 26 is preferably nylon, most preferably a 210 denier high tenacity rip-stop nylon. Preferably, there is a three-quarter (¾) ounce polyurethane coating on the interiorly-facing surfacing of the nylon, to create some resistance to water passing through the nylon.

Cradle member 28 results in holster 26 flexing to the contours of the body of the person wearing apparatus 10 and also serves to hold hydration container 20 in place within holster 26. This results from cradle member 28 being slightly in tension. When apparatus 10 is worn with belt 12 fastened securely about the wearer's waist, cradle member 28 pulls the exterior portion of holster 26, most remote from the lumbar region of the wearer, towards the lumbar region of the wearer, holding hydration container 20 securely in place. Holster 26 has a wide mouth, making removal of hydration container 20 and replacement thereof into holster 26 intuitive and very easy and quick for the wearer of apparatus 10.

Elastic segments 14 and 16 of belt 12 are selected to have sufficient elasticity to be non-restricting to the wearer and yet prevent bounce of the hydration waist pack defined by fabric segment 18, holster 26 and cradle member 28 when container 20 is in place within holster 26.

First and second elastic segments 14, 16 are attached to fabric segment 18 in a manner to maximize stability of holster 26, cradle member 28 and container 20 resident within holster 26 as the wearer of apparatus 10 is exercising. Most preferably first and second elastic segments 14, 16 are affixed to fabric segment 18 at a position which is about one-third (⅓) of the distance from the top to the bottom of container 20 when container 20 is resident in holster 26. This positioning of the points of attachment of first and second elastic segments 14, 16 to fabric segment 18 has been found to minimize bouncing of holster 26 with container 20 therewithin as the wearer of apparatus 10 is exercising.

The surface of fabric segment 18 that is in facing contact with the wearer's body when apparatus 10 is in position on the body may be nylon mesh with relatively small apertures in the nylon; this is used in smaller versions of apparatus 10 in which fabric segment 18 has relatively small area facing the wearer's back. The surface of fabric segment 18 facing the wearer's back in larger versions of apparatus 10, having larger square areas of fabric segment 18 facing the wearer's back, are desirably at least a portion of air mesh providing wicking of perspiration away from the wearer's body.

Holster 26 is configured in part by presence of flexible foam panels interior of nylon exterior material 44. Cradle member 28 is similarly configured with foam, which is a harder foam, known as "Hard Sponge" in the trade. This harder, firmer characteristic of the foam interior portion of cradle member 28 provides structural rigidity and yet flexibility, permitting holster 26 to flex to the contours of the wearer's body and yet securely retain hydration container 20 in place. While the foam interior of cradle member 28 is stiffer than the foam segments forming holster 26, the foam interior of cradle member 28 is thinner than the foam segments forming the interior of holster 26. The foam forming the interior of cradle member 28 is stitched into the seams at the top and the bottom of cradle member 28 to create more tension on the holster-cradle assembly. The foam segments defining the shape of holster 26 are inserted after seams are sewn, facilitating construction of holster 26. The foam interior of cradle member 28 is placed in position before final stitching so that the stitching can be performed in a way to place cradle member 28 in some tension, thereby providing the desired effect in causing holster 26 to flex to the contour of the body and hold hydration container 20 securely in position.

The orientation of cradle member 28 vis-à-vis holster 26 and belt 12 results in increased tension in cradle member 28 when belt 12 is wrapped around the wearer's body. Cradle member 28 is initially sewn in tension. When the wearer places belt 12 around the wearer's body, the more of a curve that is created when the belt, especially fabric segment 18, is wrapped around the body, the tighter the cradling effect produced by holster 26 results. In the preferred practice of the invention, belt 12 is designed to accommodate an average waist dimension of from thirty (30) to thirty-four (34) inches and, with cradle member 28 configured as illustrated in the drawings, creating an ideal tension for the cradle member-holster assembly and resultant retention of hydration container 20 within holster 26 during the wearer's exercise activity. The arcuate shape of cradle member 28 and the arcuate cross-sectional shape, in the longitudinal sense of, holster 26 results in a larger opening at the top area of holster 26 and a tighter, more tensioned grip of holster 26 on container 20 at the bottom of holster 26. This aids in getting container 20 into holster 26 and retains container 20 in holster 26 once container 20 is positioned there within.

Figure 3:
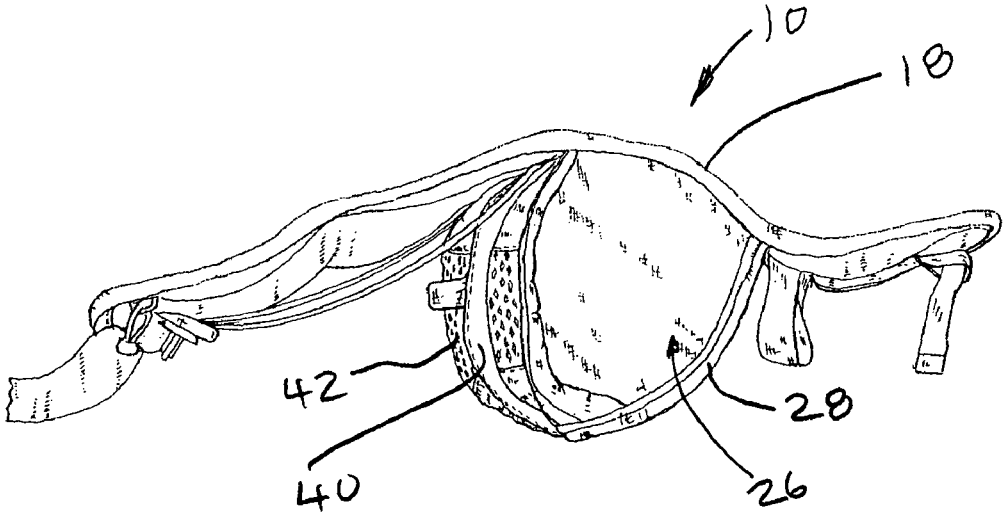
FIG. 3 is a top view of the apparatus illustrated in FIG. 1, without the beverage container and nutrition flask, and with the belt segments not completely shown.

As apparent in FIG. 3, the cross-sectional shape of holster 26 is preferably a "D-shape" where the flat portion of the "D" is against the wearer's body. At the interior surface of the holster on the flat panel forming the upright part of the "D" the material is preferably rip-stop nylon. At the exterior of the holster, which is also rip-stop nylon, this nylon is preferably not bonded to the fabric layer immediately adjacent to it, which preferably is a very fine, knit synthetic fabric. A third layer of the holster is loose, synthetic fiber bonded to the second layer and to the fourth layer, which is another synthetic knit but with larger interstices than the second layer. These layers are secured to one another at the edge of the back flat panel of the "D-shape" with stitching which goes through all four layers. The resulting construction provides a holster which is soft against the body of the wearer.

The illustrated diagonal orientation of holster 26 relative to belt 12 in FIG. 1 facilitates withdrawal and reinsertion of container 20 from and into holster 26.

Construction of apparatus 10 is preferably all by sewing; preferably, no adhesive is used. In the area between the mid-portion of cradle member 28 and lip 38 of holster 26, there is a knit fabric having very large interstices and which is highly flexible; this fabric does not hold any preset shape.

Cradle member 28 desirably extends from a horizontal position, at approximately the center of holster 26 where cradle member 28 is affixed to holster 26, extending in an arc-like manner to a vertical position at which cradle member 28 is affixed to belt 12, preferably to fabric segment 18 of belt 12. The combination of cradle member 28 and holster 26 effectively creates a "cradle" for container 20 and also serves to stabilize holster 26 as a part of the entire assembly.

Figure 18:
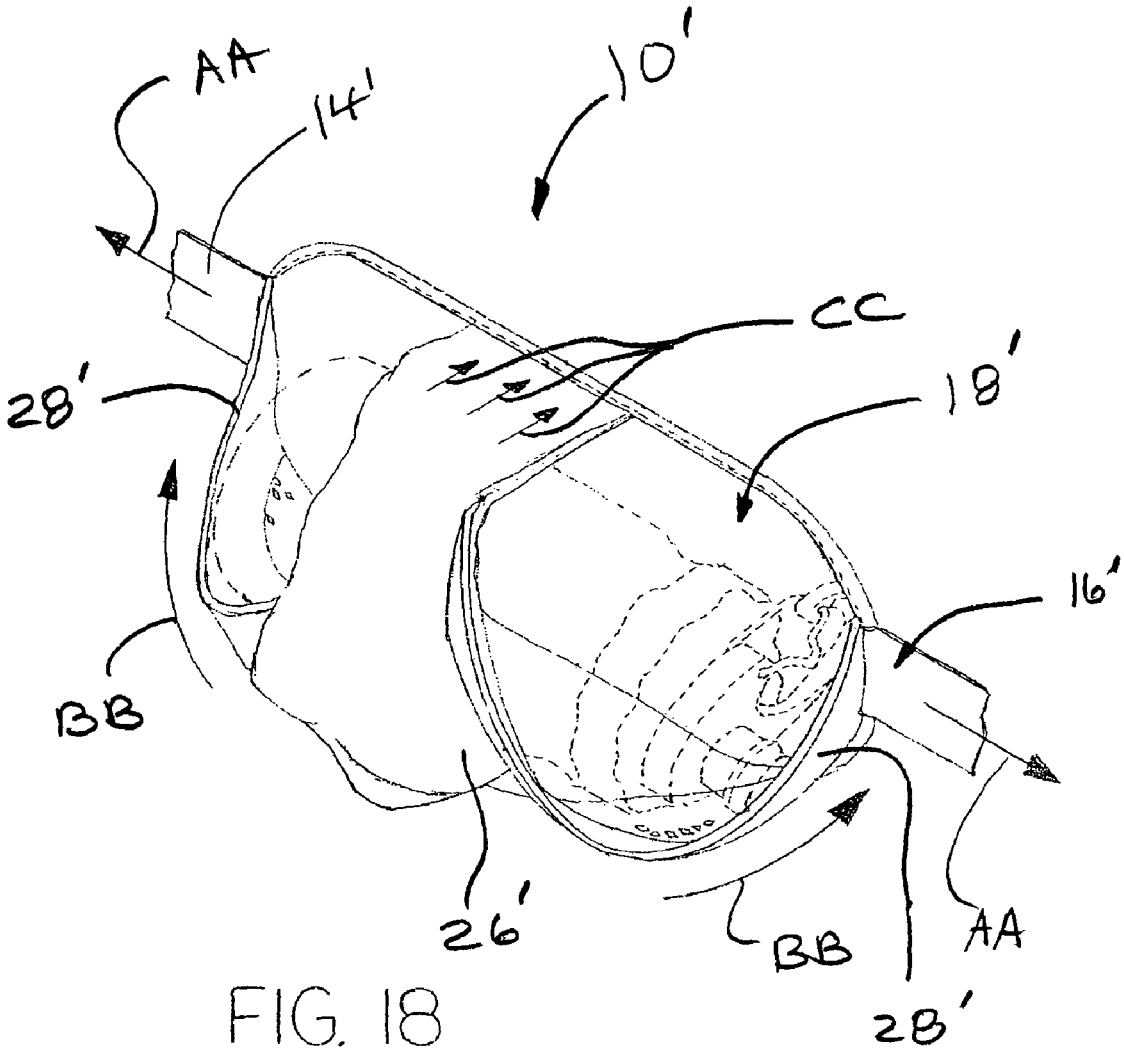
FIG. 18 is a isometric schematic depiction of load bearing members and forces resulting in apparatus when the apparatus is worn, in accordance with an alternate embodiment of the invention, having a holster for carrying a hydration beverage container horizontally, in either of two orientations, whereby the bottle cap extends from either the left or the right opening of the holster.
Figure 19:
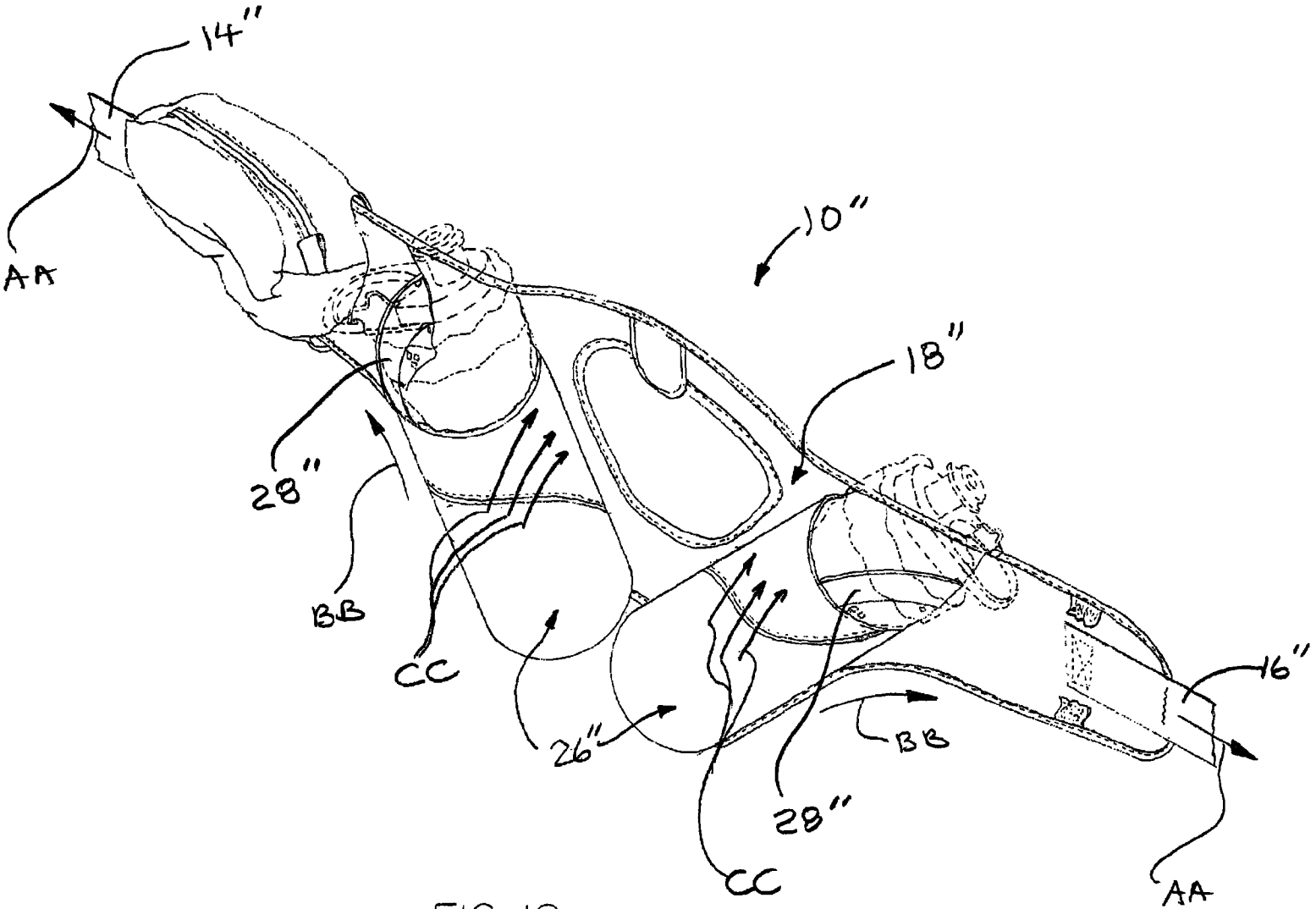
FIG. 19 is a isometric schematic depiction of the load bearing members and forces resulting in apparatus when the apparatus is worn, in accordance with a further alternate embodiment of the invention, having two holsters, for carrying two hydration beverage containers at an angle to the horizontal, in an orientation similar to that of the apparatus of FIGS. 1 through 5. Certain details of the apparatus have been omitted from FIG. 19 to enhance drawing clarity.
Figure 20:
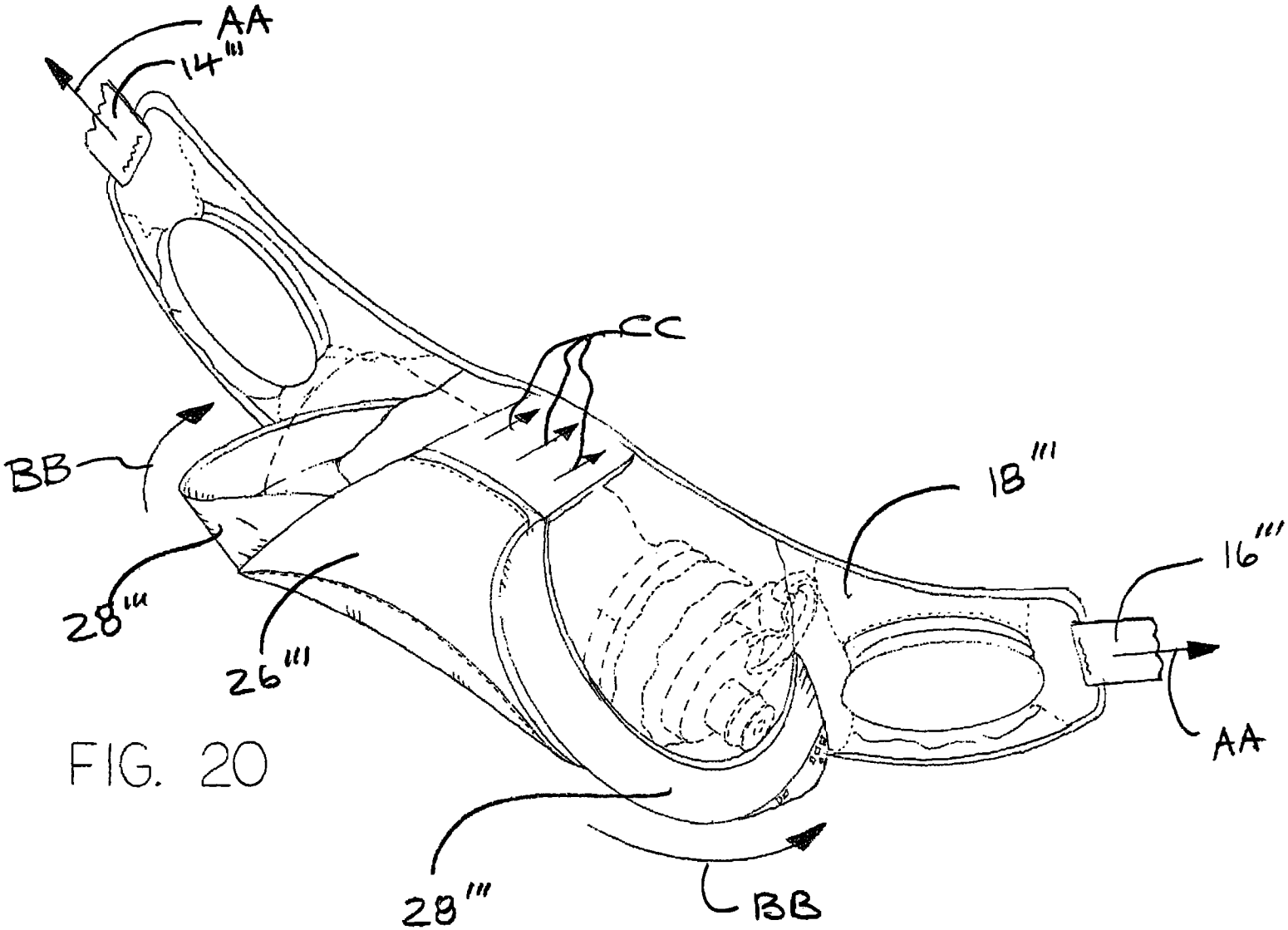
FIG. 20 is a isometric schematic depiction of the load bearing members and resulting forces in apparatus, in accordance with a yet further alternate embodiment of the invention designed particularly for women, having a single holster for carrying a hydration beverage container in a horizontal position and configured to facilitate withdrawal of the hydration beverage container from either side. Certain details of the apparatus have been omitted from FIG. 20 to enhance drawing clarity.
Figure 21:
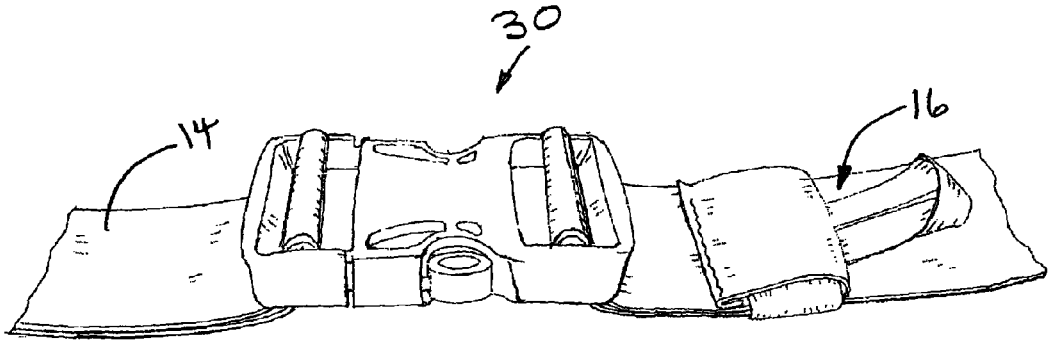
FIG. 21 is an isometric view of a clasp and attachment thereto of an elastic belt segment of apparatus in accordance with the invention.
Figure 22:
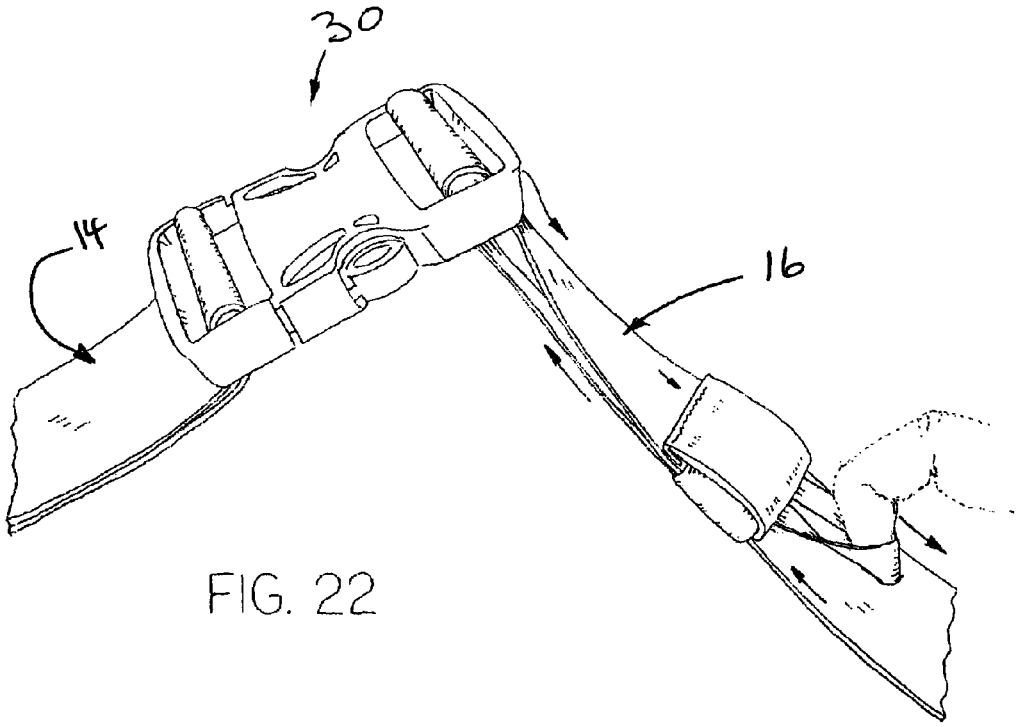
FIG. 22 is an isometric view similar to FIG. 21 but illustrating the manner in which the length of the elastic segment attached to the clasp segment can be adjusted, namely can be lengthened, by application of finger force. Forces on and movements of portions of the segment are denoted by the arrows.
Figure 23:
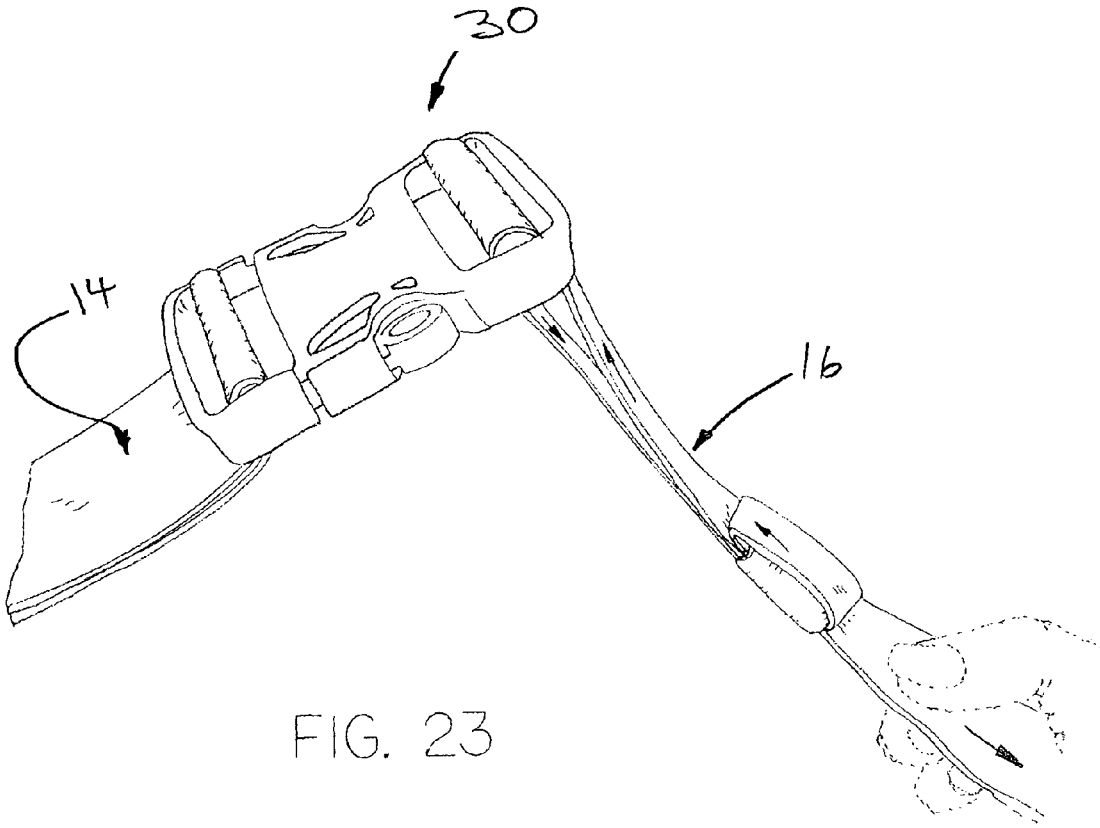
FIG. 23 is an isometric view similar to FIG. 22 but illustrating the fixed, tightened nature of the connection between the elastic segment and the clasp in accordance with this aspect of the invention. Forces on and movements of portions of the segment are denoted by the arrows.

As illustrated in FIGS. 18 and 20, holster 26 may further be oriented horizontally so as to hold container 20 in a horizontal position. This provides a lower profile for apparatus 10 on the wearer's back. Additionally, container 20 in a horizontal orientation permits either left-handed or right-handed grasping of container 20 by the wearer while exercising. Another advantage of the horizontal orientation of container 20 is less noise—liquid within container 20 sloshes less when container 20 is in a horizontal position than would the liquid if container 20 were in a vertical or close to vertical orientation.

Desirably, fabrics used in construction of apparatus 10 are nylon other than the mesh materials illustrated in the drawings. These mesh materials are preferably nylon-polyester combinations. Foams used in construction of apparatus 10 are preferably closed-cell, polyurethane foams with higher and lower durometer foam portions being used as indicated above, to provide relative stiffness in cradle member 28 and less stiffness in holster 26. A sheet of high-density polyethylene may also be used or applied to one surface of the nylon as appropriate to reduce moisture penetration. When apparatus 10 is worn, it is designed so that the fabric segment 18 is placed at the center of the wearer's back on the rear of the wearer's body.

Figure 4:
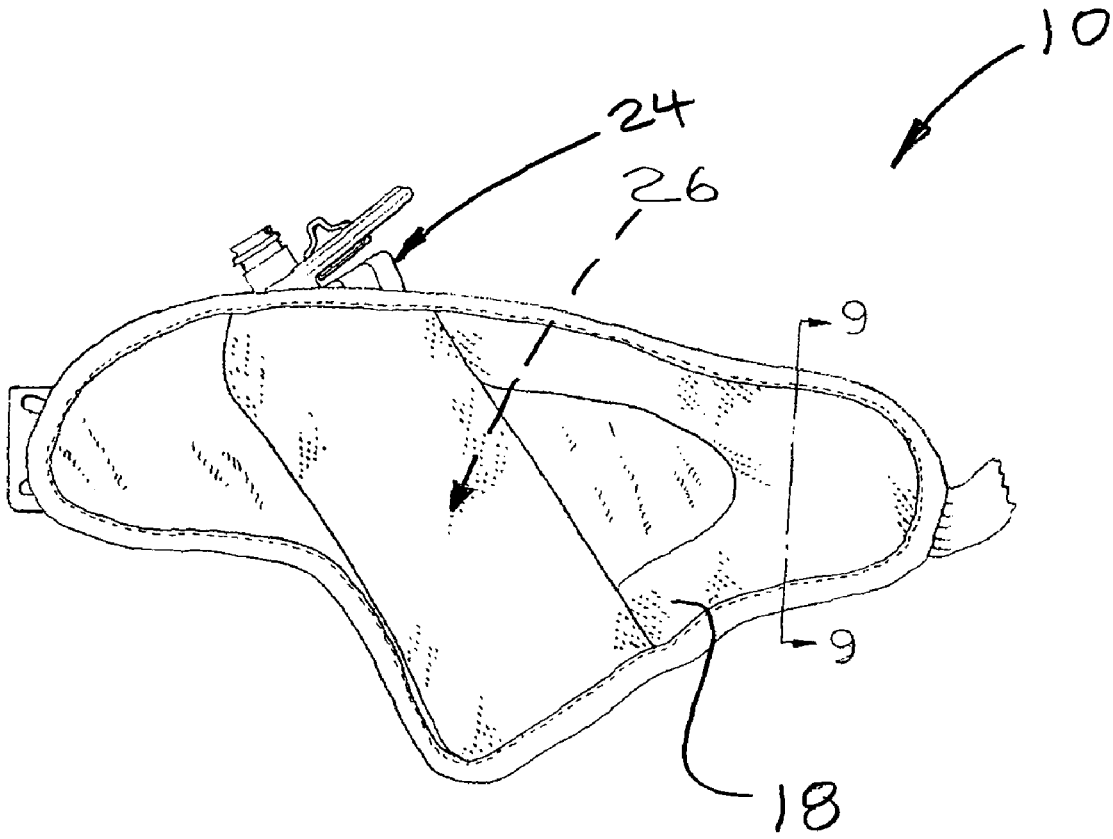
FIG. 4 is a broken rear elevation, with the belt portion broken away, of a lumbar backing portion of the apparatus illustrated in FIG. 1, with the hydration beverage container in position in the apparatus for carriage by a person using the apparatus.
Figure 5:
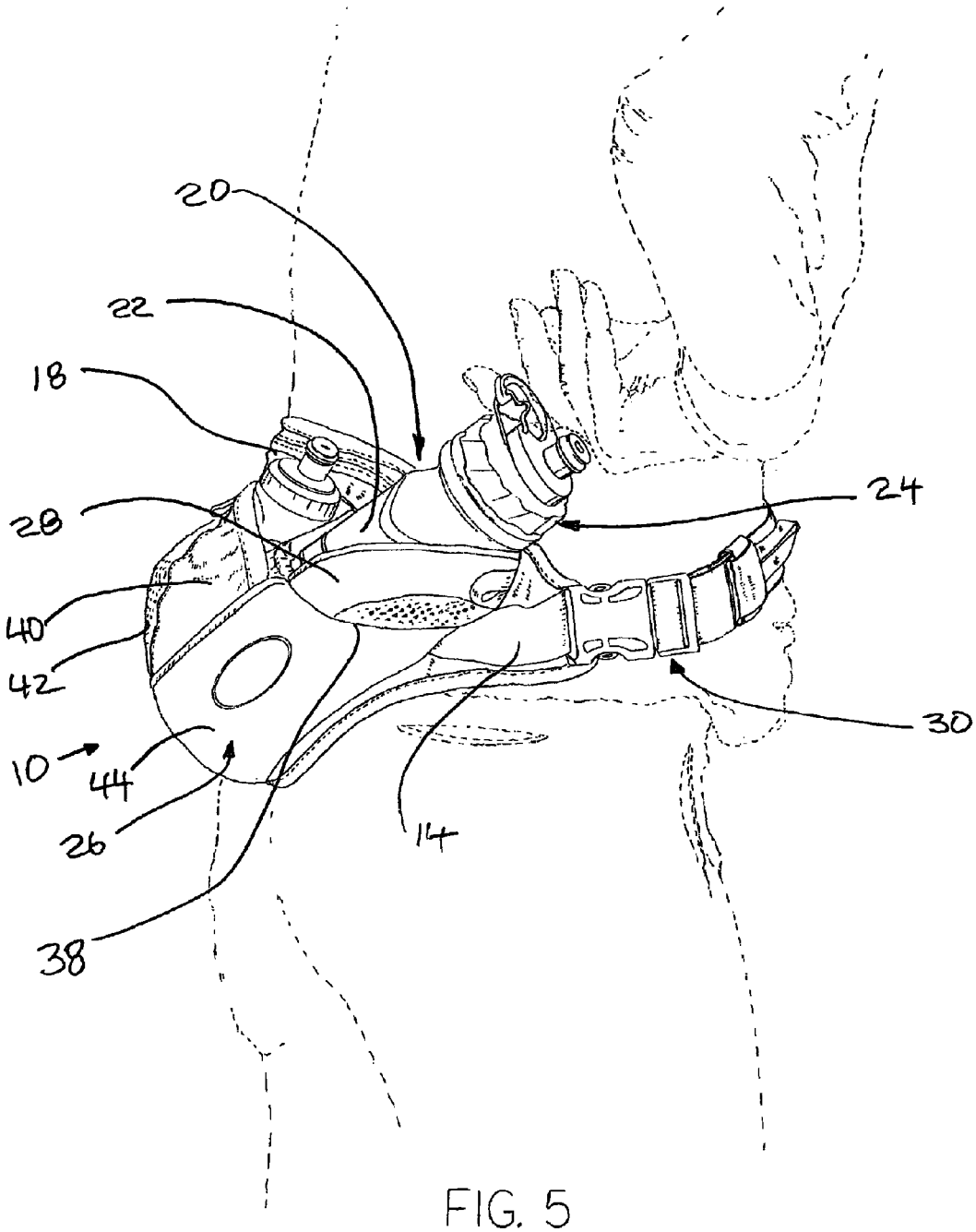
FIG. 5 is an isometric depiction of the apparatus of FIG. 1, with the hydration beverage container and the nutrition flask in place, being worn by an exercising person, who is in the midst of withdrawing the hydration beverage container from the holster portion of the apparatus.

In drawing FIGS. 6, 7, 8 and 9 illustrating internal construction of apparatus in accordance with the invention and particularly the construction at the sections defined by the corresponding arrows in FIGS. 1 and 4, different forms of shading appearing in FIGS. 6, 7, 8 and 9 define materials used in the construction of apparatus according to the invention.

Figure 6:
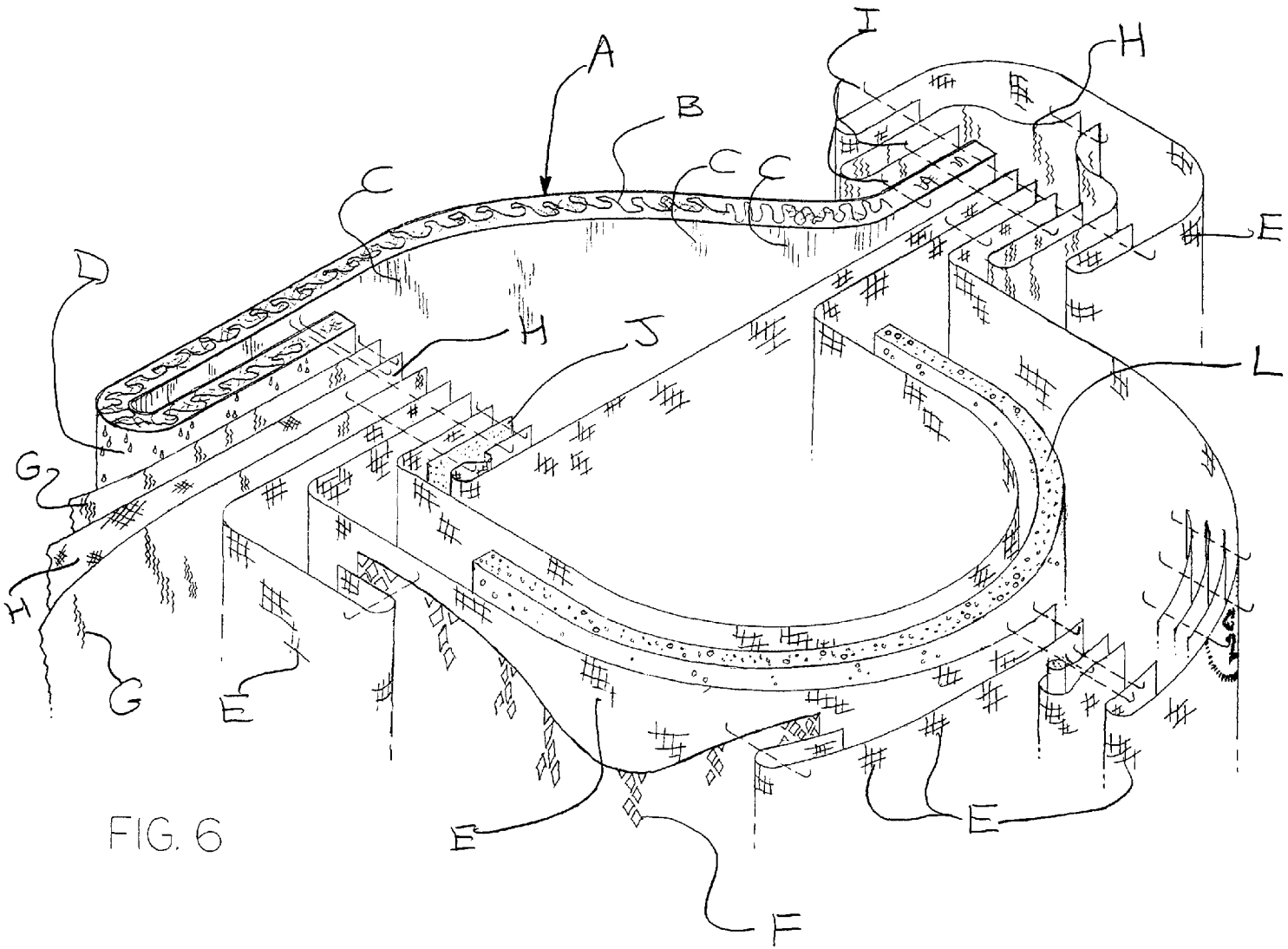
FIG. 6 is an exploded schematic sectional view depicting a lower part of the holster portion of the apparatus illustrated in FIGS. 1 through 6, taken at lines and arrows 6-6 in FIG. 1.

Specifically, in FIG. 6, arrow A generally denotes a mesh having a fiber fill where the fiber fill is indicated by the continuous squiggled line identified by B. A finer mesh bounding one side of the fiber fill is denoted by intermittent vertical lines identified by C. The opposite side of the fiber fill, which is defined by coarser mesh, is identified with teardrop type markings as indicated by D. Rip stop nylon is denoted by rectangular cross hatching indicated by E. Large open mesh is indicated by diamonds identified by F.

Additional mesh, some of which becomes an exterior surface of the apparatus when extended from the position illustrated in FIG. 6, is identified on wavy, vertical lines denoted G.

Non-rip stop nylon is indicated by cross hatching at a 45° angle and denoted H. Sewing threads are denoted by dashed lines and indicated I. Woven material backing is indicated by stippling and identified as J. Foam is identified by intermittent circular stippling of random size and identified by L.

Figure 7:
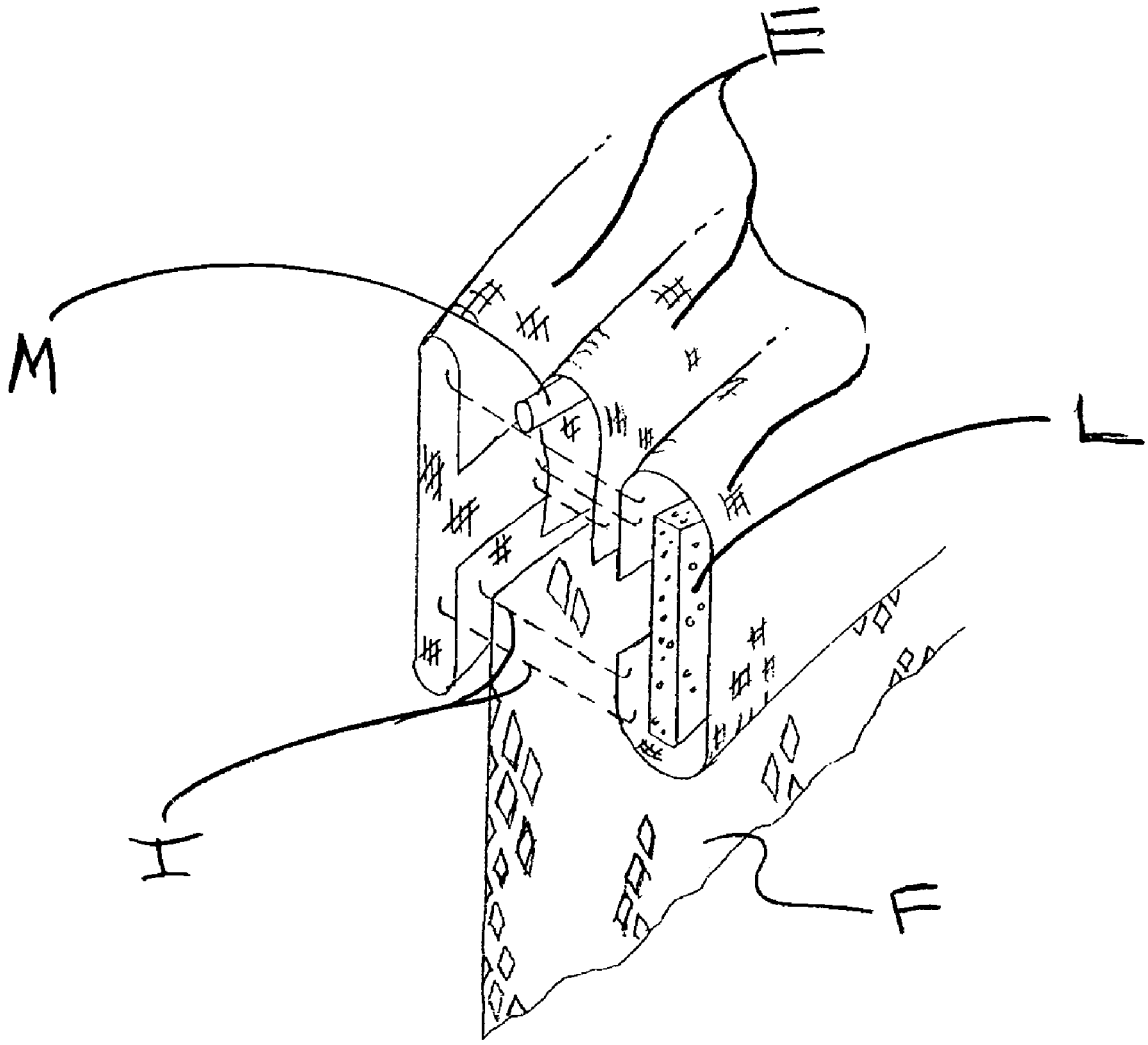
FIG. 7 is an exploded schematic sectional view depicting a cradle portion of the apparatus illustrated in FIGS. 1 through 6, taken at lines and arrows 7-7 in FIG. 1.
Figure 8:
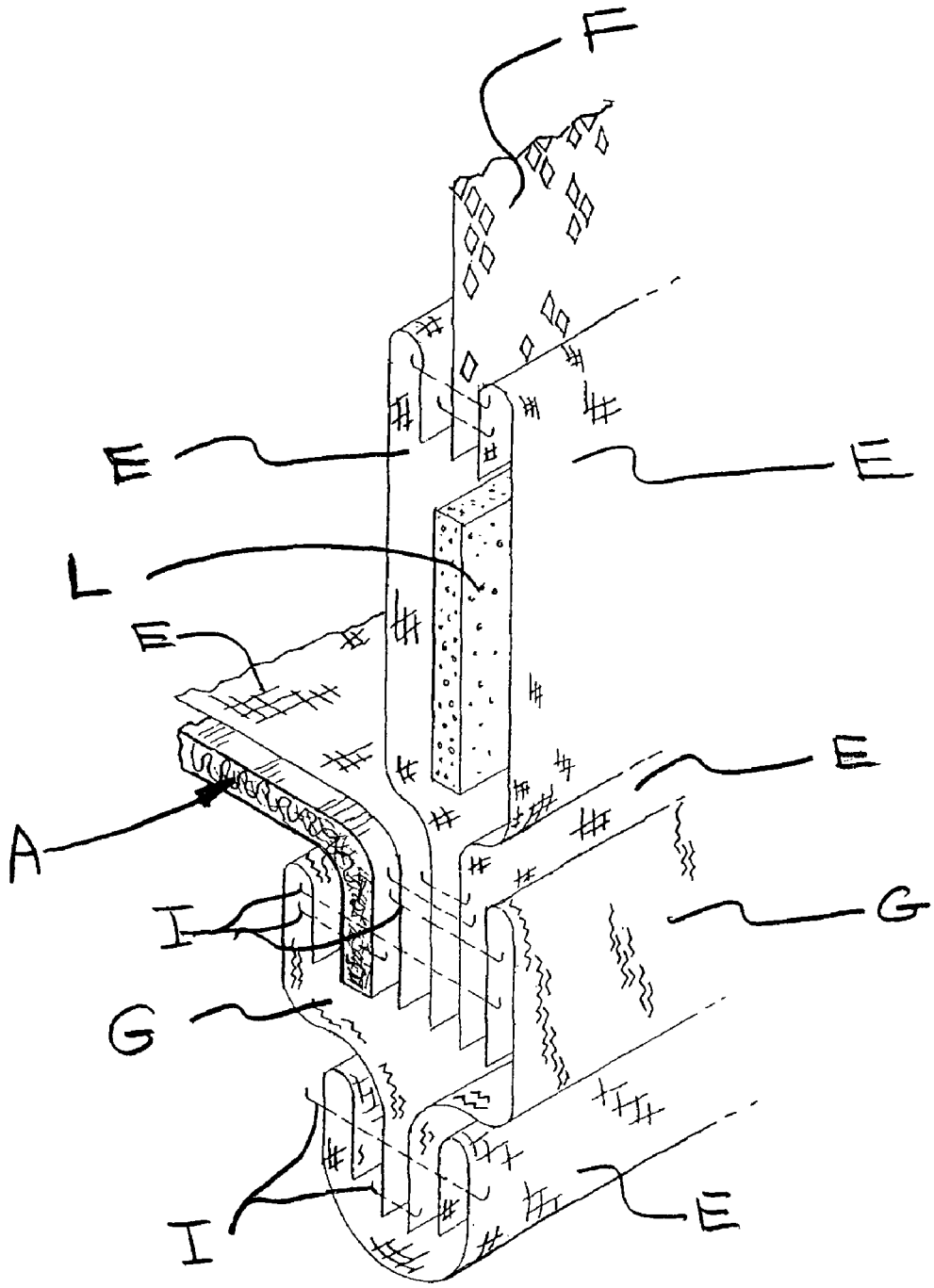
FIG. 8 is an exploded schematic sectional view depicting an upper part of the holster portion of the apparatus illustrated in FIGS. 1 through 6, taken at lines and arrows 8-8 in FIG. 1.

The same letters are used throughout FIGS. 6, 7, 8 and 9 to identify the various materials used in constructing apparatus according to the invention. The foam depicted in FIG. 7 should be understood to be a higher durometer, stiffer foam than the foam depicted in FIGS. 6 and 8 since FIG. 7 depicts the foam of the cradle member.

Cording is indicated by a cylindrical member and identified as M in FIG. 7.

Figure 9:
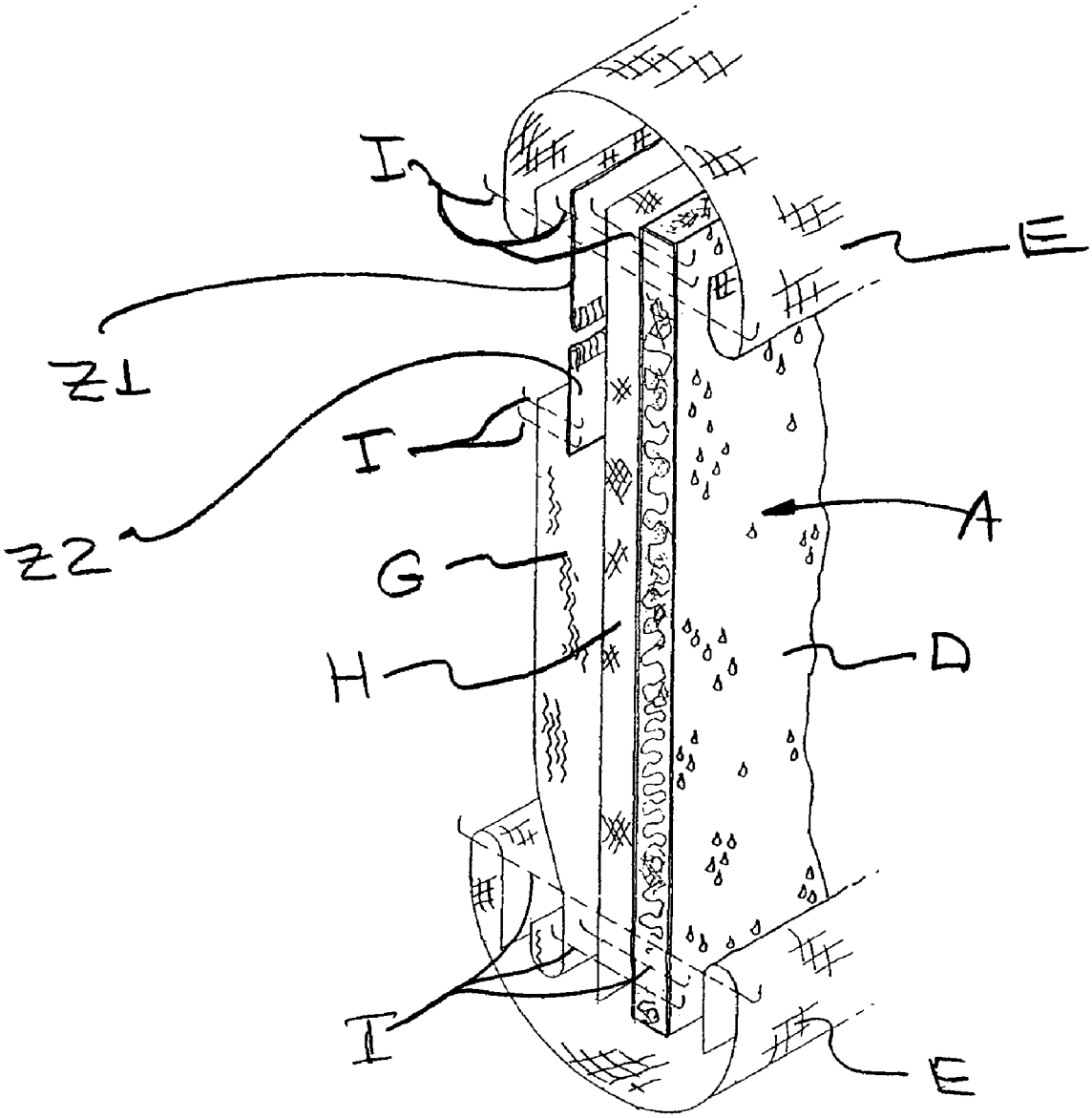
FIG. 9 is an exploded schematic sectional view depicting a lumbar backing portion of the apparatus illustrated in FIGS. 1 through 6, taken at lines and arrows 9-9 in FIG. 4.

The two halves of the zipper are denoted Z1 and Z2 in FIG. 9.

Figure 10:
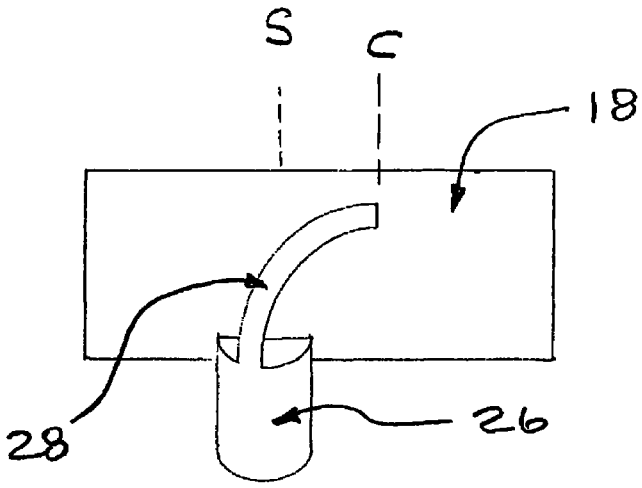
FIG. 10 is schematic front elevation of an exemplary lumbar support, holster and cradling band in accordance with the invention, illustrating the configuration of the lumbar support, holster and cradling band prior to the apparatus, that includes this lumbar support, holster and cradling band, prior to being worn.
Figure 11:
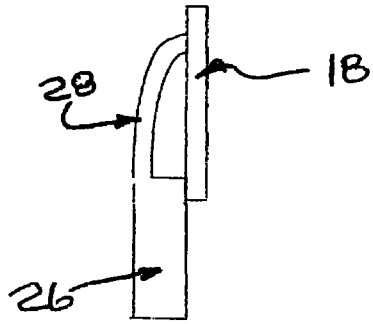
FIG. 11 is schematic side elevation of the exemplary lumbar support, holster and cradling band in accordance with the invention, illustrated in FIG. 10.
Figure 12:
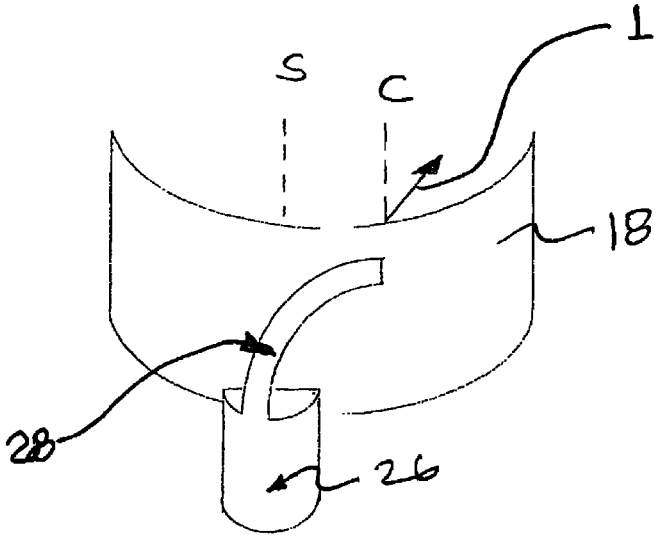
FIG. 12 is schematic front elevation of an exemplary lumbar support, holster and cradling band in accordance with the invention, similar to FIG. 10 but illustrating the configuration of the lumbar support, holster and cradling band while the apparatus, that includes this lumbar support, holster and cradling band, is worn.
Figure 13:
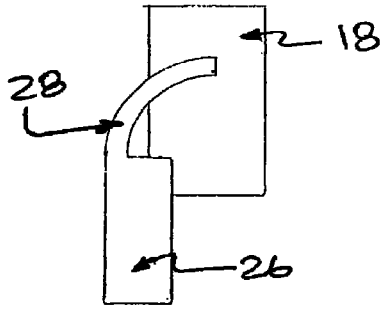
FIG. 13 is schematic side elevation of the exemplary lumbar support, holster and cradling band in accordance with the invention, illustrated in FIG. 12

In FIGS. 10 and 12, dashed vertical line S denotes the approximate mid-point of the wearer's back, generally coincident with the wearer's spine. Dotted vertical line C in FIGS. 10 and 12 denotes the position of connection between cradle member 28 and fabric segment 18 of belt 12. Arrow 1 in FIG. 12 indicates the direction of movement and hence of force created in cradle member 28 as belt 12 is tightened around the waist of wearer. The movement of cradle member 28 and particularly the position of the connection thereof with fabric segment 18 upon the tightening of belt 12 by a wearer is further illustrated by FIG. 13 when that figure is compared with FIG. 11.

Figure 14:
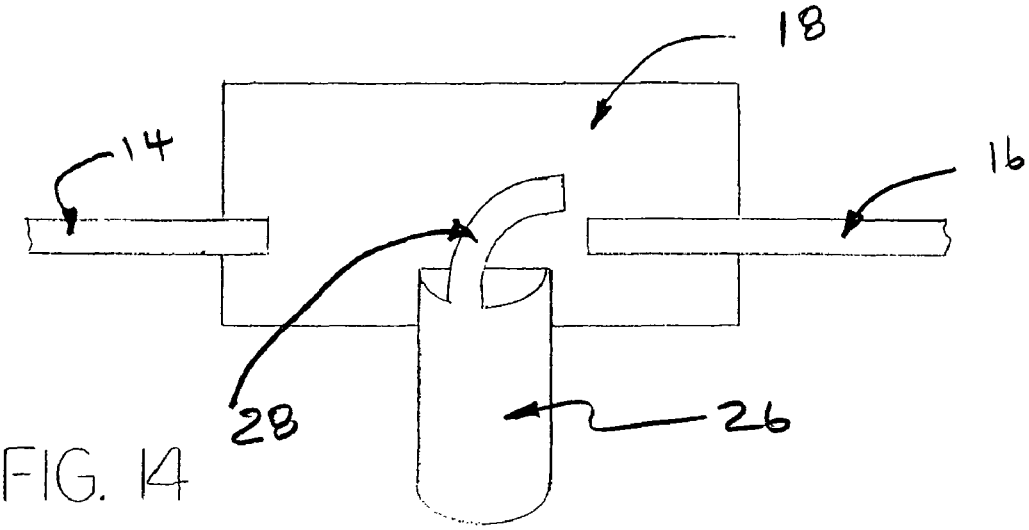
FIG. 14 is schematic front elevation of an exemplary lumbar support, holster, cradling band and elastic belt segments in accordance with the invention, illustrating one orientation the lumbar support, cradling band and belt segments in the apparatus.
Figure 15:
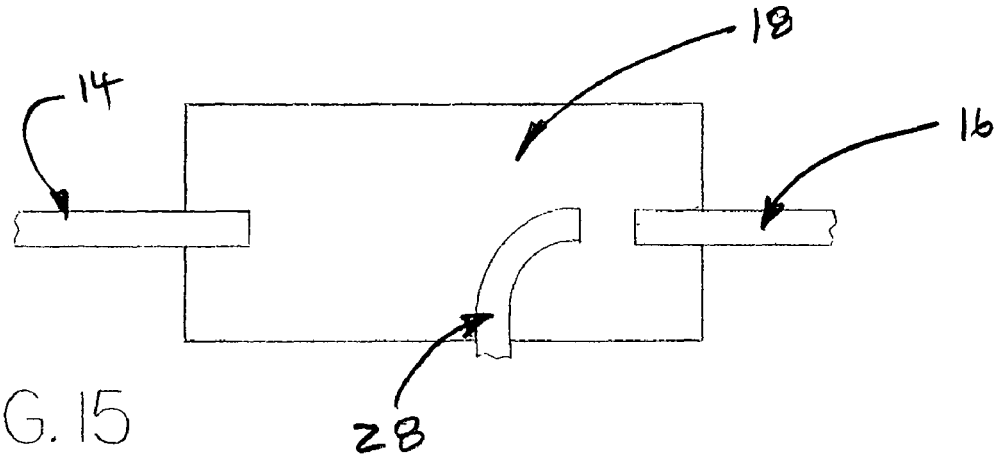
FIG. 15 is schematic front elevation of an exemplary lumbar support, cradling band and elastic belt segments in accordance with the invention, similar to FIG. 14 but illustrating a second orientation the lumbar support, cradling band and belt segments in the apparatus.
Figure 16:
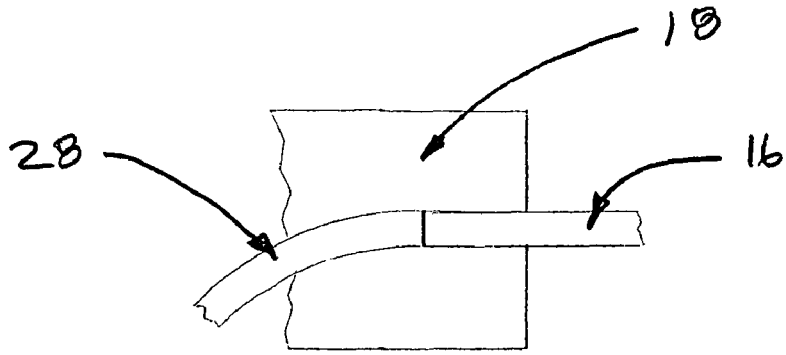
FIG. 16 is schematic front elevation of an exemplary lumbar support, cradling band and elastic belt segments in accordance with the invention, similar to FIGS. 14 and 15 but illustrating a third orientation the lumbar support, cradling band and belt segments in the apparatus.
Figure 17:
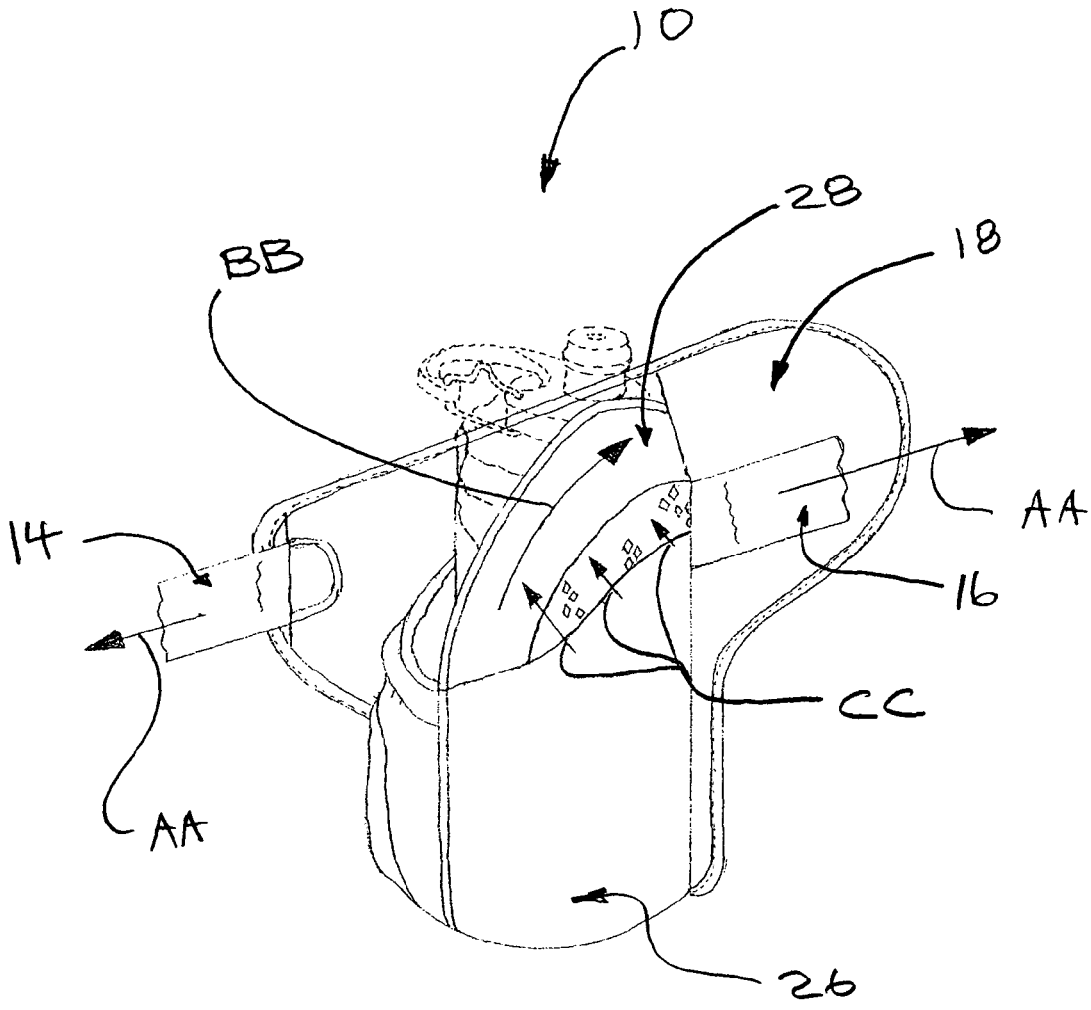
FIG. 17 is a isometric schematic depiction of load bearing members and resulting forces in the apparatus illustrated in FIGS. 1 through 5 when the apparatus is worn. Certain details of the apparatus have been omitted from FIG. 17 to enhance drawing clarity.

FIGS. 14, 15 and 16 illustrate various configurations as to the positioning of the point of attachment of cradle member 28 to fabric segment 18 vis-à-vis first and second elastic segments 14, 16 of belt 12. In FIG. 14, cradle member 28 is affixed to fabric segment 18 at a position above the centerline of first and second elastic segments 14, 16. In FIG. 15, cradle member 28 is affixed to fabric segment 18 at a position aligned with the centerline of first and second elastic segments 14, 16 but with cradle member 28 spaced away from first and second elastic segments 14, 16. In FIG. 16, cradle member 28 is depicted affixed to fabric segment 18 in a position aligned with and essentially connected to one of the elastic segments 14, 16.

In FIGS. 17 through 20, arrows AA indicate tension applied in the course of securing belt 12 around the body of a wearer. Arrows BB denote resulting force, in the nature of a tension, created in cradle member 28 due to the tightening of belt 12. Arrows CC indicate the force produced on holster 26 as cradle member 28 draws the outer portion of holster 26 towards the body of the wearer.

Airmesh is used extensively in the various embodiments of apparatus of the invention to provide wicking. This three dimensional mesh uses "push-pull" technology—polyester against the skin draws moisture from the body and nylon fibers transfer the moisture away to promote rapid evaporation. There fibers also provide cushioning, resulting in greater comfort to the wearer.

The invention claimed is:

1. Apparatus for maintaining a beverage container within reach of an exercising person wearing the apparatus, comprising:

a) a belt for fitting about the person's waist;

b) a holster connected to the belt, for releasably retaining therewithin a beverage container bottle;

c) an integrally continuous cradling member extending in an arc-like manner between the holster and the belt, a midsection of an edge of the cradling member being arcuately distant from the holster, a first end of the cradling member being sewn to the belt transversely to the belt centerline, a second end of the cradling member being sewn to a holster lip and being aligned therewith, wherein the cradling member results in the holster flexing to hold the container in place within the holster.

2. Apparatus of claim 1 wherein the connection of the cradle member causes the flexing of the holster when the belt wrapped around the person's waist.

3. Apparatus of claim 1 wherein the connection of the cradle member creates tension between the holster and the belt.

4. Apparatus of claim 1 wherein the cradling effect of the holster is created when the belt is wrapped around the person's body when the apparatus is worn.

5. Apparatus for maintaining a beverage container within reach of an exercising person wearing the apparatus, comprising:

a) a belt adapted for adjustable fitting about a torso of the person;

b) a open mouth holster connected to the belt, for retaining therewithin a generally cylindrical beverage container;

c) an integrally continuous cradling member extending in an arc-like manner between the holster and the belt, being sewn to both the holster and the belt at respective cradling member extremities but being arcuately distant therefrom along a middle portion of an edge of the cradling member, wherein the cradling member causes the holster to flex with force and thereby preventing the container from exiting the holster in response to movement of the holster as the person traverses over ground, but permitting the container to be withdrawn from the holster and thereafter replaced back into the holster by the person.

6. Apparatus of claim 5 wherein the first cradling member extremity is connected to the holster so that it is parallel with a lip of the holster and at a position outboard of and remote from the belt, and the second cradling member extremity is connected to the belt such that a tension is created between the holster and the belt by the connections of the cradling member extremities.

7. Apparatus of claim 5 wherein the holster further comprises: a) a fabric outer curved surface; b) a fabric inner curved surface; and c) an interior resilient portion sandwiched between the inner and outer surfaces, remote from connection of the holster to the belt; wherein the holster is connected to the belt so that the holster is at an angle to the vertical when the belt is around the person's torso.

* * * * *